US011033769B2

(12) United States Patent
Yin et al.

(10) Patent No.: US 11,033,769 B2
(45) Date of Patent: Jun. 15, 2021

(54) EXERCISING DEVICE FOR MUSCLE STRENGTHENING

(71) Applicants: Memphis Zhihong Yin, Tomball, TX (US); Wendy Wen Xiong, Tomball, TX (US)

(72) Inventors: Memphis Zhihong Yin, Tomball, TX (US); Wendy Wen Xiong, Tomball, TX (US)

( * ) Notice: Subject to any disclaimer, the term of this patent is extended or adjusted under 35 U.S.C. 154(b) by 6 days.

(21) Appl. No.: 16/562,760

(22) Filed: Sep. 6, 2019

(65) Prior Publication Data

US 2021/0069541 A1 Mar. 11, 2021

(51) Int. Cl.

| | |
|---|---|
| ***A63B 21/045*** | (2006.01) |
| ***A63B 21/00*** | (2006.01) |
| ***A63B 21/02*** | (2006.01) |
| ***A63B 23/035*** | (2006.01) |

(52) U.S. Cl.

CPC .... *A63B 21/0455* (2013.01); *A63B 21/00185* (2013.01); *A63B 21/026* (2013.01); *A63B 21/4033* (2015.10); *A63B 23/03533* (2013.01)

(58) Field of Classification Search

CPC ..... A63B 21/0004; A63B 21/0455; A63B 21/00185; A63B 21/026; A63B 21/4033; A63B 23/03533; A63B 21/00072; A63B 21/0083; A63B 21/00069; A63B 21/4047; A63B 21/023; Y10S 482/909

See application file for complete search history.

(56) References Cited

U.S. PATENT DOCUMENTS 677,824 A * 7/1901 Troxler ..... A63B 23/16 482/49
4,632,384 A * 12/1986 Bright ..... A63B 23/03508 482/49
4,772,016 A * 9/1988 Manion ..... A63B 21/0004 482/112
5,224,914 A * 7/1993 Friedman ..... A63B 21/0004 482/127

* cited by examiner

*Primary Examiner* — Nyca T Nguyen
*Assistant Examiner* — Andrew M Kobylarz
(74) *Attorney, Agent, or Firm* — NZ Carr Law Office PLLC

(57) ABSTRACT

Embodiments of the present disclosure relate to an exercise device. In one embodiment, an exercise device includes a first arm and a second arm opposing the first arm. The first arm includes a first arc portion, a second arc portion, and a third arc portion, wherein the first arc portion is disposed between and coupled to the second arc portion and the third arc portion, and the second arc portion and the third arc portion are equal in size and a duplicate image of each other with respect to an axis passing through a center point of the first arc portion. The second arm is coupled to the first arm via a pair of parallel bars. The first arm and the second arm are a duplicate image of each other, and the first arm, the second arm, and the pair of parallel bars form a quadrilateral frame.

17 Claims, 5 Drawing Sheets

EXERCISING DEVICE FOR MUSCLE STRENGTHENING

BACKGROUND

Field

Embodiments disclosed herein relate to an exercise device that can be used to for muscle strengthening and fat burning.

Description of the Related Art

Nowadays people, especially those at work are always lack of time to work out and keep body in shape. Statistic data shows human body when aging, develops fat more quickly around the areas of abdomen, upper arm (bingo wing), waist and thigh. The effective way for removal of the excessive fat is to train local muscle groups regularly and constantly. The frustration for people to keep this regular training is there is none of a unitary device that is simple yet multi-functional that is dedicated to precise local muscle exercise. The major problem for most relevant products on the market are either ergonomically unfavorable or complex constructed that are not comfort and easy to use, which discourage usage that results in ineffectiveness in body shaping.

Therefore, there exists a need for an exercise device that gives multi-function and is simple to build and reliable to use, while allowing users to perform a wide variety of exercises each provides a different form of stimulation to selected muscles of the abdomen, arms, shoulders, and legs.

SUMMARY

In one embodiment, an exercise device includes a first arm and a second arm opposing the first arm. The first arm includes a first arc portion, a second arc portion, and a third arc portion, wherein the first arc portion is disposed between and coupled to the second arc portion and the third arc portion, and the second arc portion and the third arc portion are equal in size and a duplicate image of each other with respect to an axis passing through a center point of the first arc portion. The second arm is coupled to the first arm via a pair of parallel bars. The first arm and the second arm are a duplicate image of each other, and the first arm, the second arm, and the pair of parallel bars form a quadrilateral frame.

In another embodiment, the exercise device includes a first U-shaped arm, a second U-shaped arm, a first linear bar, and a second linear bar. The second U-shaped arm opposes the first U-shaped arm and is a mirror image of the first U-shaped arm. The second linear bar opposes the first linear bar and is a mirror image of the first linear bar. The first U-shaped arm is coupled to the first linear bar and the second linear bar, respectively, and the second U-shaped arm is coupled to the first linear bar and the second linear bar, respectively, and the first U-shaped arm, the second U-shaped arm, the first linear bar and the second linear bar are connected to form a quadrilateral frame.

In yet another embodiment, the exercise device includes a first arm and a second arm coupling to the first arm via a pair of parallel bars. The first arm includes a first member, a second member, and a third member, wherein the first member is in a round-bend configuration, and the second member and the third member are in a linear configuration. The second arm includes a first member, a second member, and a third member, and the first member of the second arm is in a round-bend configuration, and the second member and the third member of the second arm are in a linear configuration.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Figure 1:
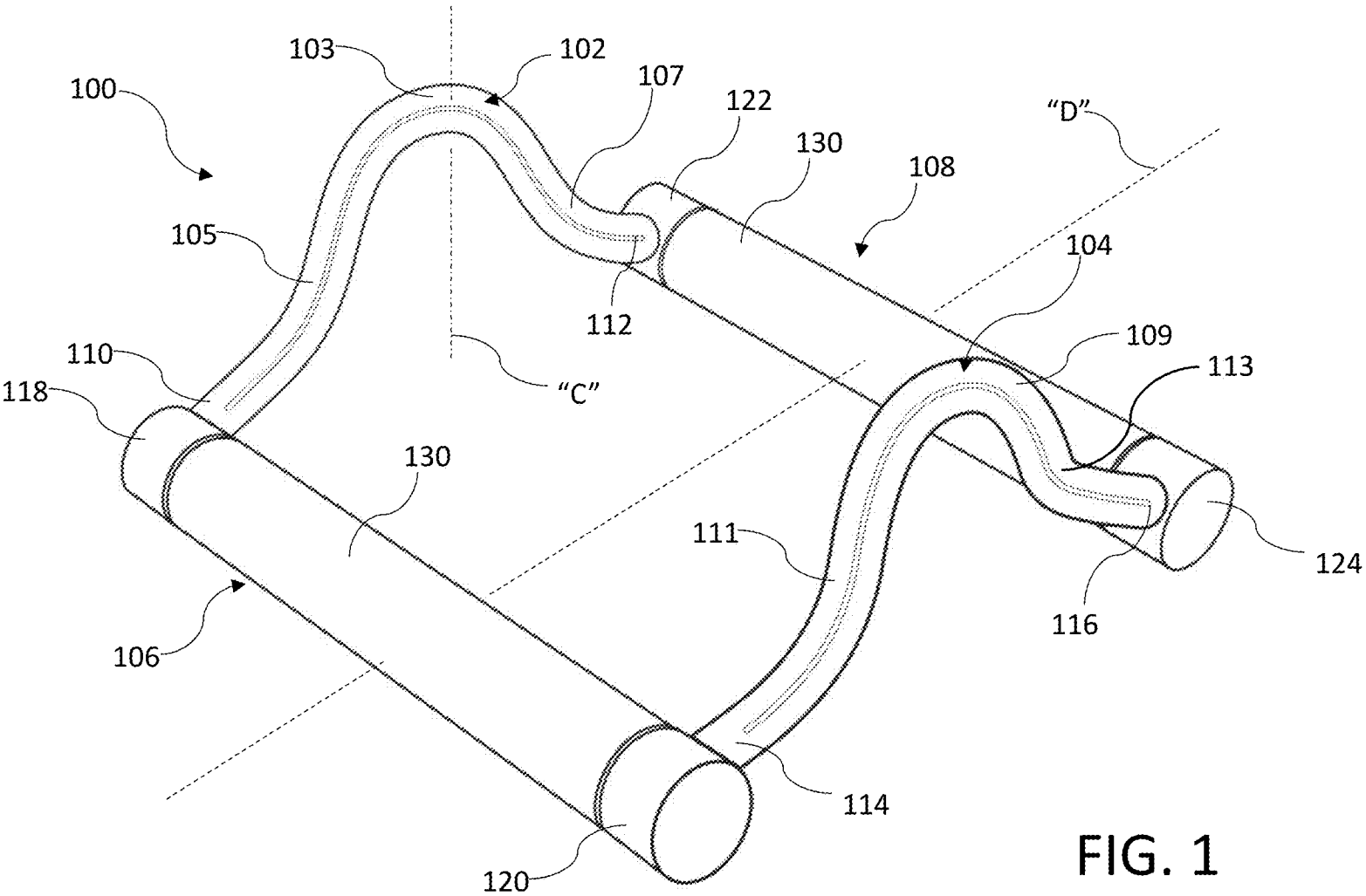
FIG. 1 is a perspective view of an exercise device according to embodiments of the present disclosure.

FIG. 1 is a perspective view of an exercise device 100 according to embodiments of the present disclosure. The exercise device 100 is generally consisted of two U-shaped (or C-shaped) arms 102, 104 and two bars 106, 108. The U-shaped arms 102, 104 are located on either side of the exercise device 100. The bars 106, 108 are parallel to each other and coupled to the ends of the U-shaped arms 102, 104, respectively, to form a quadrilateral frame. When the bars 106, 108 intersect with a common horizontal plane, the U-shaped arms 102, 104 form a convex upward (when viewing from the side). That is, the U-shaped arms 102, 104 form a general convex profile when the bars 106, 108 intersect with the common horizontal plane, with apex of each U-shaped arms 102, 104 pointing away from the bars 106, 108.

The U-shaped arm 102 generally includes a first arc portion 103, a second arc portion 105, and a third arc portion 107. The second arc portion 105 and the third arc portion 107 are coupled to the first arc portion 103, which is in a general round-bend configuration. The first arc portion 103, the second arc portion 105, and the third arc portion 107 are formed as an integrated part. The second arc portion 105 and the third arc portion 107 may further include a linear portion extending outwardly in a direction away from the first arc portion 103. In such a case, the linear portion may be in a straight configuration. Alternatively, the second arc portion 105 and the third arc portion 107 may further include a non-linear portion extending outwardly in a direction away from the first arc portion 103.

The first arc portion 103, the second arc portion 105 and the third arc portion 107 are essentially co-planar. The second arc portion 105 and the third arc portion 107 are equal in size and a duplicate image of each other with respect to an axis "C" passing through the center point of the U-shaped arm 102. The axis "C" referred to herein is essentially perpendicular to a tangent line at the center point of the U-shaped arm 102.

The second arc portion 105 has one end coupling to the first arc portion 103 and another end terminating at a distal end 110 that is directly connected to an end 118 of the bar 106. Likewise, the third arc portion 107 has one end coupling to the first arc portion 103 and another end terminating at a distal end 112 that is directly connected to an end 122 of the bar 108.

The U-shaped arm 102 and the U-shaped arm 104 are duplicate image of each other with respect to an axis "D" passing through centers of the bars 106 and 108, respectively. Similarly, the U-shaped arm 104 generally includes a first arc portion 109, a second arc portion 111, and a third arc portion 113. The second arc portion 111 and the third arc portion 113 are coupled to the first arc portion 109, which is in a general round-bend configuration. The first arc portion 109, the second arc portion 111, and the third arc portion 113 are formed as an integrated part. The second arc portion 111 and the third arc portion 113 may further include a linear portion extending outwardly in a direction away from the first arc portion 109. In such a case, the linear portion may be in a straight configuration. Alternatively, the second arc portion 111 and the third arc portion 113 may further include a non-linear portion extending outwardly in a direction away from the first arc portion 103.

The first arc portion 109, the second arc portion 111 and the third arc portion 113 are essentially co-planar. The second arc portion 111 and the third arc portion 113 are equal in size and a duplicate image of each other with respect to the axis "C" passing through the center of the U-shaped arm 102. The second arc portion 111 has one end coupling to the first arc portion 109 and another end terminating at a distal end 114 that is directly connected to an end 120 of the bar 106. Likewise, the third arc portion 113 has one end connecting to the first arc portion 109 and another end terminating at a distal end 116 that is directly connected to an end 124 of the bar 108.

In some embodiments, the ends 118, 120, 122, and 124 may be constructed as an end-cap having one side that can be removably attached to respect ends of the bars 106, 108, and anther side that can be removably attached to respect ends of the second arc portions 105, 111, and the third arc portions 107, 113.

The U-shaped arms 102, 104 may be coupled to the bars 106, 108 by any suitable method, such as welding, soldering, brazing, screw fastening, adhesive bonding, or any of combination thereof to form a unitary structure. Additionally or alternatively, the U-shaped arms 102, 104 can be removably coupled to the bars 106, 108 through, for example, the use of the end cap, by fasteners such as screws/bolts, or other suitable locking mechanism such as snap-fit, twist-lock engagement, or the like.

Figure 5:
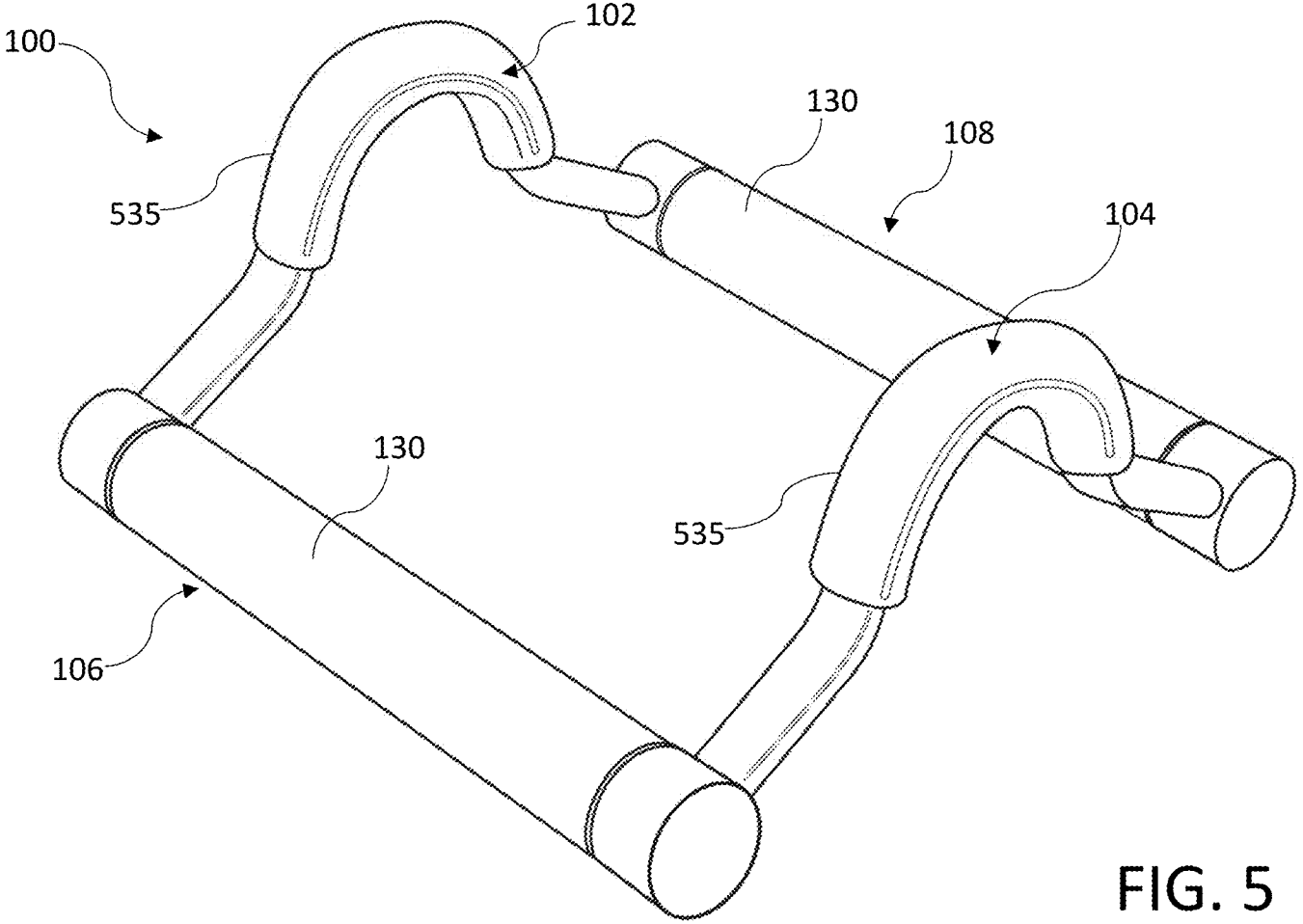
FIG. 5 is a cross-sectional view of a portion of a U-shaped arm according to embodiments of the present disclosure.

The U-shaped arms 102, 104 are dimensioned to a suitable length for comfortable human body contact. The bars 106, 108 can be wrapped with a soft form material 130 such as rubber, foam rubber, foam synthetic resin, or other suitable elastic material that can be comfortably grasped by a user. Portions or all of the U-shaped arms 102, 104 can also be wrapped with a soft rubber material, or any suitable compressible material such as elastic rubber. In one embodiment shown in FIG. 5, for example, the first arc portions 103, 109 of the U-shaped arms 102, 104 is further wrapped with a soft rubber material 535. Textures, patterns, grains, or the like, may be added to the soft form material 130 and/or the soft rubber material 535 to facilitate grasping of the exercise device 100 by the user. For example, each of the U-shaped arms 102, 104 may have a plurality of grooves (not shown) disposed around the soft rubber material 535 (FIG. 5).

Referring back to FIG. 1, each of the U-shaped arms 102, 104 and the bars 106, 108 can have various cross-sectional shapes, such as round, oval, rounded polygon, rectangular, square, etc. The U-shaped arms 102, 104 are made of resilient materials such as metals, bamboo, plastics, rubber, wood, synthetic elastomer etc., which resists compression and which returns essentially to its original shape upon a release of an applied force. In one embodiment, the U-shaped arms 102, 104 are flat or sheet metal plate.

Figure 2:
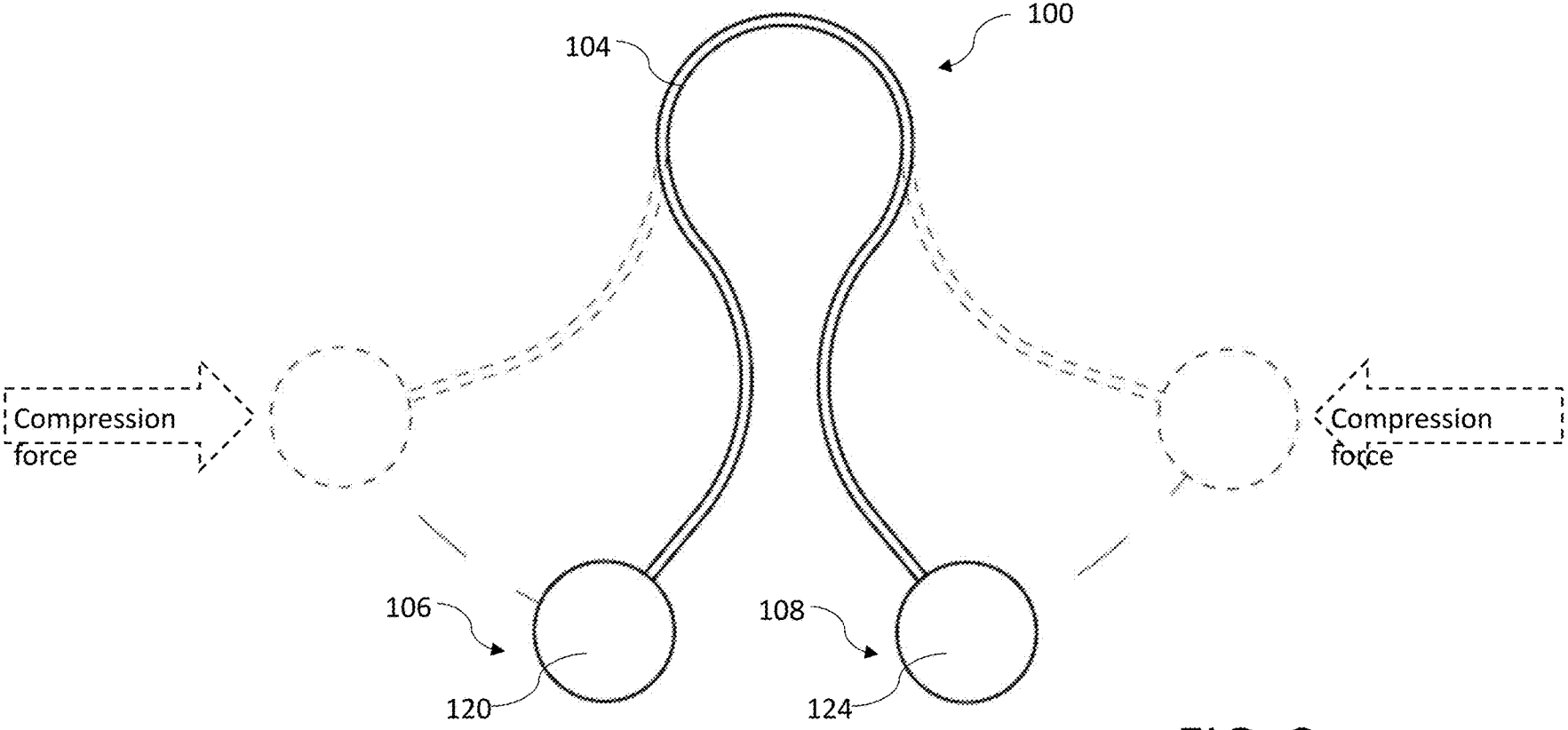
FIG. 2 is a cross-sectional view of a portion of a U-shaped arm in compressed configuration according to embodiments of the present disclosure.

As shown in FIG. 2, when the bars 106, 108 are engaged with human body for the compression action, the two resilient U-shaped arms 102, 104 (only U-shaped arm 104 is shown for clarity) produce the counterforce resistance during the movement. The counterforce resistance is translated and/or worked on targeted muscle and joint which results in reinforcement of the muscle and reduction of fat accumulation. The U-shaped arms 102, 104 are specifically shaped and configured using embodiments discussed below with respect to FIG. 3 to provide the desired resistant force when being compressed.

Figure 3:
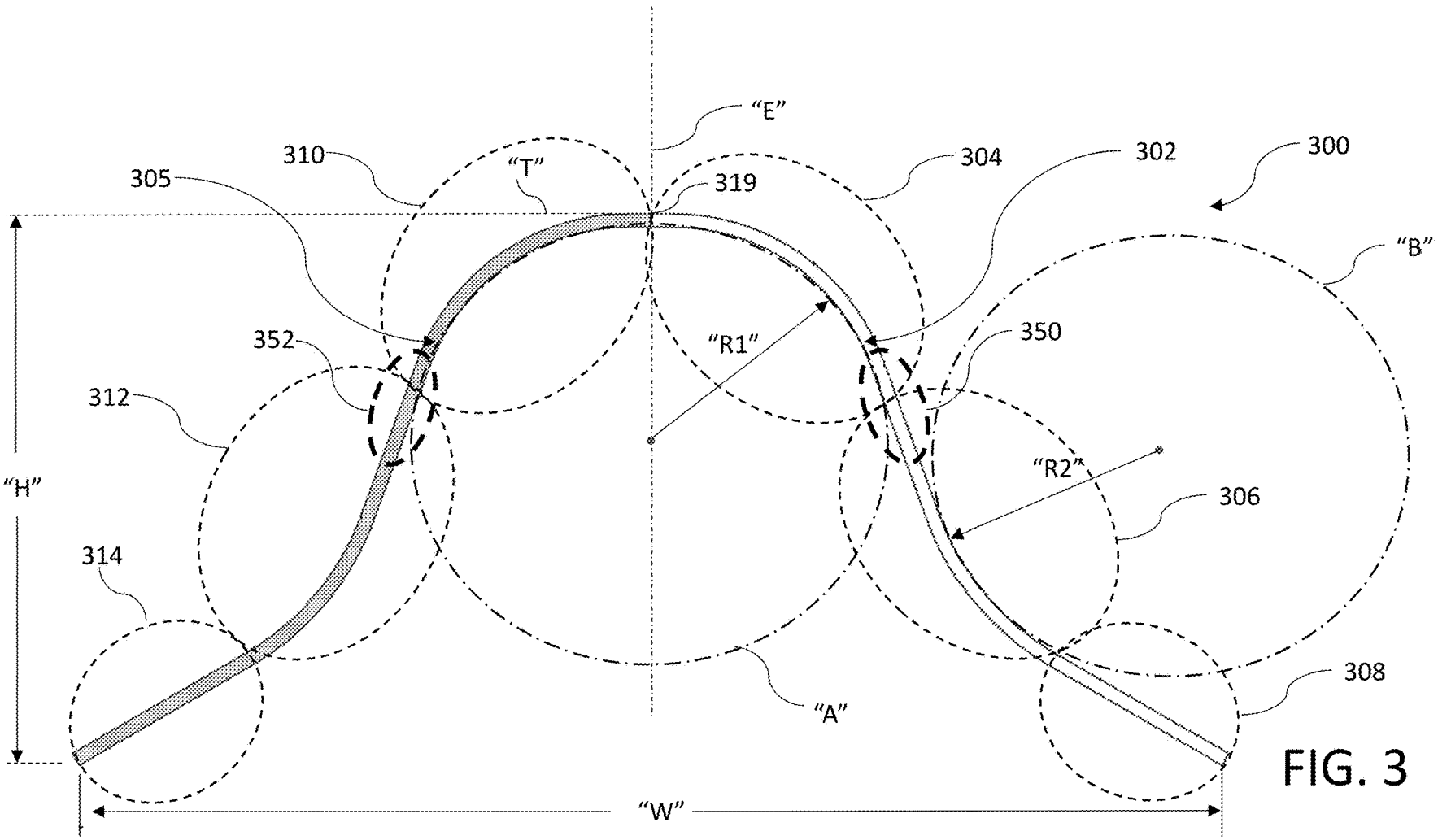
FIG. 3 is a cross-sectional view of a portion of a U-shaped arm according to embodiments of the present disclosure.

FIG. 3 is a side view of a portion of a U-shaped arm 300 that can be conceptually applied to, or used to replace, at least a portion of the U-shaped arms 102, 104 discussed in this disclosure. The U-shaped arm 300 is constructed in the form of a first part 302 and a second part 305, wherein an end of the second part 305 is connected to an end of the first part 302. first part 302 and the second part 305 are formed as an integrated part. The second part 305 is highlighted in gray for illustrative purposes only. The first part 302 and the second part 305 are co-planar and symmetric. The first part 302 and the second part 305 are equal in size and a duplicate image of each other with respect to an axis "E" passing through a center point of the U-shaped arm 300. The axis "E" is essentially perpendicular to a tangent line "T" passing through the center apex 319 of the U-shaped arm 300.

The U-shaped arm 300 is leveraged/modified from a standard coil spring but customized to provide resilient force. The first part 302 is generally consisted of a first arc portion 304, a second arc portion 306, and a linear portion 308. The second arc portion 306 is disposed between the first arc portion 304 and the linear portion 308. The second arc portion 306 may be coupled directly to the first arc portion 304 and the linear portion 308. In one embodiment, the first arc portion 304 is convexly curved and the second arc portion 306 is concavely curved, with respect to the axis "E". That is, the vertex of the first arc portion 304 is pointing away from the axis "E" while the vertex of the second arc portion 306 is pointing towards the axis "E". The first arc portion 304 and the second arc portion 306 may have the same or similar curvature. In one aspect, the first arc portion 304 has a radius of curvature "R1" identical to the radius of curvature "R2" of the second arc portion 306.

Alternatively or additionally, the second arc portion 306 may couple indirectly to the first arc portion 304. In such a case, an intermediate portion 350 may be further disposed between the first arc portion 304 and the second arc portion 306. The intermediate portion 350 may be a linear or non-linear portion and can be made of a resilient material, such as those discussed in this disclosure. In one example, the intermediate portion 350 is a linear straight portion coupling the first arc portion 304 to the second arc portion 306.

The second part 305 includes a first arc portion 310, a second arc portion 312, and a linear portion 314. The first arc portion 310 is convexly curved and the second arc portion 312 is concavely curved, with respect to the axis "E". The first arc portion 310 and the second arc portion 312 of the second part 305 may have the same or similar curvature.

Likewise, the second arc portion 312 may be connected directly to the first arc portion 310 and the linear portion 314.

Alternatively or additionally, the second arc portion 312 may couple indirectly to the first arc portion 310. In such a case, an intermediate portion 352 may be further disposed between the first arc portion 310 and the second arc portion 312. The intermediate portion 352 may be a linear or non-linear portion made of a resilient material, such as those discussed in this disclosure. In one example, the intermediate portion 252 is a linear straight portion coupling the first arc portion 310 to the second arc portion 312.

The resilient force is generated from the first part 302 and the second part 305 of the U-shaped arm 300. Each of the first part 302 and the second part 305 consists of double-arc configuration, which can be represented by the imaginary circles "A" and "B". This special design can be recognized by a modification from dual coil torsion springs that are deliberately integrated in a consecutive connection. The combination of the double-arc configuration allows the U-shaped arm 300 to provide resilient force that is not solely from the material but the double-arc geometry of the U-shaped arm 300, which means even least flexible material, such as wood, can offer resilient force when formed in such double-arc configuration. When compressed, the preloaded resilient force from either side of the U-shaped arm 300 is translated and/or delivered to targeted muscle and joint which results in reinforcement of the muscle and fat burning.

The U-shaped arm 300 can be modified based on any coil torsion springs. For example, the resilient arm can be shaped as O-shaped coil like torsion spring. It is contemplated that additional spring(s) can be attached on the U-shaped arm 300 as resistant force adjustor.

Figure 4:
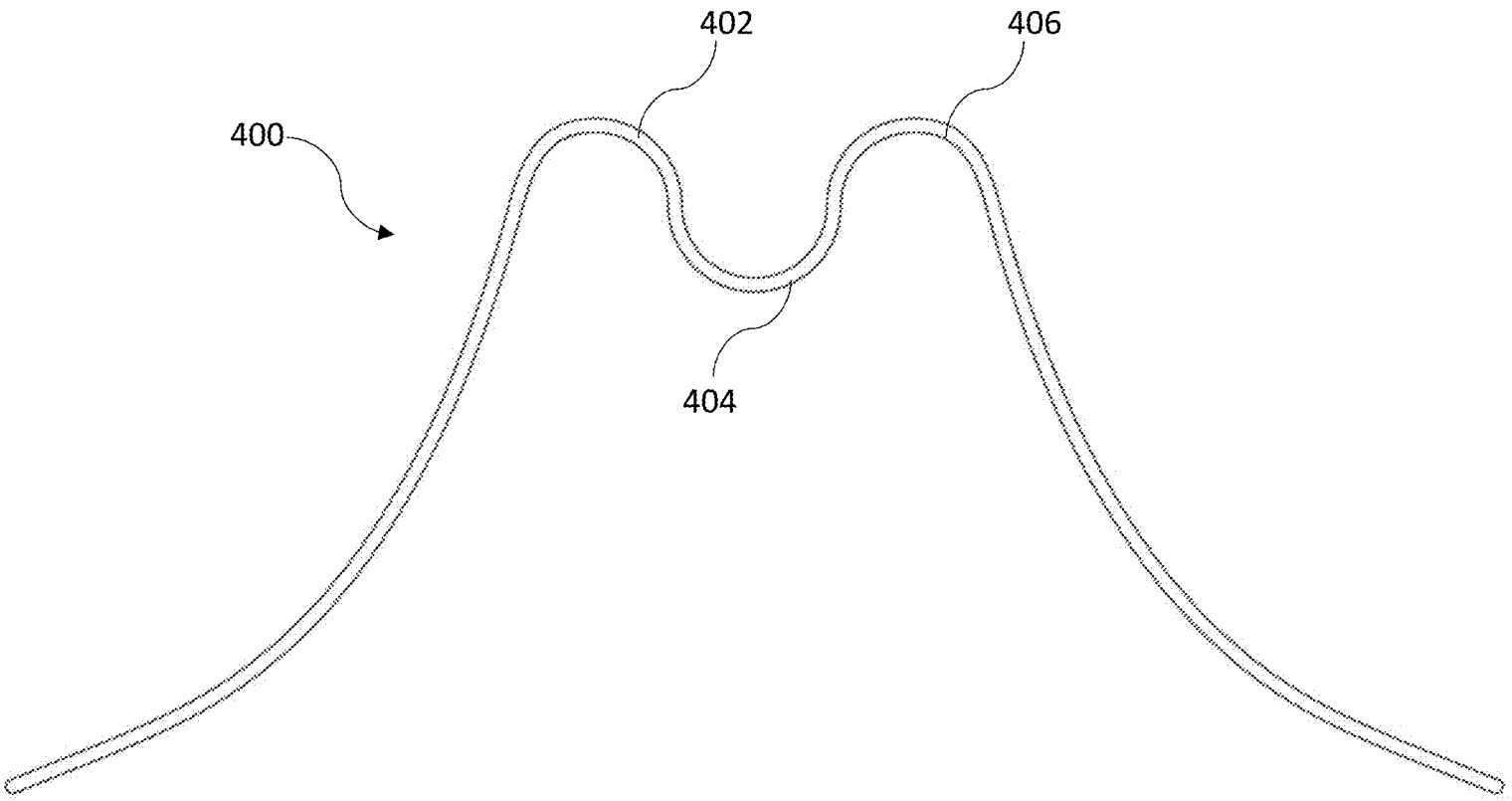
FIG. 4 is a perspective view of an exercise device according to embodiments of the present disclosure.

Various modifications can be made to the U-shaped arms of the inventive exercise device. For example, the first arc portions 103, 109 of the U-shaped or C-shaped arm in this disclosure can be plurally formed in consecutive sequence to form a M-shaped configuration. FIG. 4 illustrates a side view of a portion of an exemplary U-shaped arm 400 that can be conceptually applied to, or used to replace, the U-shaped arms discussed in this disclosure. In this embodiment, the U-shaped arm 400 is configured in a M-shaped including at least a first arc portion 402, a second arc portion 404, and a third arc portion 406. The first arc portion 402 and the third arc portion 406 are convex, with the second arc portion 404 being concave and disposed between the first arc portion 402 and the third arc portion 406. The first arc portion 402, the second arc portion 404, and the third arc portion 406 may be co-planar and have the same or similar radius of curvature. Any number of arc portions are contemplated and can be added to provide needed resilient force for the exercise device.

If desired, a motion sensor, such as an accelerometer, may be integrated within the exercise device to record exercise action/number which can be connected or wirelessly connected to a digital device, such as a smart phone, a tablet, a laptop computer, etc.

The exercise device of the present disclosure features a lightweight, functional, reliable and cost-effective solution to all abdominal or multifunctional training devices known in the market, which often requires complex mechanisms using mechanical torsion spring to provide resilient force. In contrast, the inventive exercise device utilizes unitary resilient U-shaped or C-shaped arms to generate resistance force completely from the arms that are made of resilient material. Therefore, there is no force created from mechanical component or assembly like torsion spring which provides artificial and mechanical force. Benefitting from uniform single resilient arm, when arms pressed the device bends naturally and generate ergonomic, natural and smooth counterforce resistance verse mechanical torsion spring used on other similar devices. The configuration of the exercise device is so simple that it is versatile in both body accommodation and outside body interaction in exercising the different muscle groups. It targets primarily on abdomen, triceps, pectorals, quadriceps (leg). Other parts of body can also be treated when appropriately engaged with the exercise device.

While the foregoing is directed to embodiments of the disclosure, other and further embodiments of the disclosure thus may be devised without departing from the basic scope thereof, and the scope thereof is determined by the claims that follow.

The invention claimed is:

1. An exercise device, comprising:

a first U-shaped arm, comprising:

a first part and a second part, wherein the first part and the second part are a mirror image of each other and formed as an integrated part, wherein the first part comprises:

a first arc portion that is concavely curved with respect to an axis passing through a center point of the first U-shaped arm, wherein the axis is essentially perpendicular to a tangent line passing through a center apex of the first U-shaped arm, and an apex of the first arc portion is pointing away from the axis; and a second arc portion that is convexly curved with respect to the axis with an apex of the second arc portion pointing towards the axis, and the first arc portion is connected to the second arc portion at a turning point where curvature of the first U-shaped arm changes from convex to concave, and the first part only has one turning point;

a second U-shaped arm, the second U-shaped arm opposing the first U-shaped arm and being a mirror image of the first U-shaped arm;

a first linear bar; and a second linear bar, the second linear bar opposing the first linear bar and being a duplicate image of the first linear bar, wherein the first U-shaped arm is coupled to a first end of the first linear bar and the second linear bar, respectively, and the second U-shaped arm is coupled to a second end of the first linear bar and the second linear bar, respectively, and wherein the first U-shaped arm, the second U-shaped arm, the first linear bar and the second linear bar are connected to form a quadrilateral frame.

2. The exercise device of claim 1, wherein the first U-shaped arm and the second U-shaped arm are made of a resilient material.

3. The exercise device of claim 2, wherein the resilient material comprises a metal, bamboo, plastics, rubber, wood, or synthetic elastomer.

4. The exercise device of claim 1, wherein the first U-shaped arm and the second U-shaped arm form a general convex profile when the first linear bar and the second linear bar intersect with a horizontal common plane, with apex of each first U-shaped arm and the second U-shaped arm pointing away from the first linear bar and the second linear bar.

5. The exercise device of claim 1, wherein the first U-shaped arm and the second U-shaped arm are the mirror image of each other.

6. The exercise device of claim 1, wherein the first U-shaped arm and the second U-shaped arm are coupled to the first linear bar and the second linear bar via welding, soldering, brazing, screw fastening, adhesive bonding, or any of combination thereof.

7. The exercise device of claim 1, wherein the first U-shaped arm and the second U-shaped arm are wrapped with a compressible material.

8. The exercise device of claim 1, wherein the first U-shaped arm and the second U-shaped arm have a cross-sectional shape of round, oval, rounded polygon, rectangular, square, or the like.

9. The exercise device of claim 1, wherein the first arc portion and the second arc portion are tangent connected.

10. An exercise device, comprising:

a first arm comprising a first member, a second member, and a third member, the first member being in a round-bend configuration, and the second member and the third member being in a linear configuration, wherein the first member comprises:

a first arc portion having a first end and a second end;

a second arc portion having a first end coupling to the first end of the first arc portion and a second end coupling to the second member;

a third arc portion having a first end and a second end, the first end of the third arc portion coupling to the second end of the first arc portion; and a fourth arc portion having a first end coupling to the second end of the third arc portion and a second coupling to the third member, wherein the first arc portion and the second arc portion are connected at a first turning point where curvature of the first arm gradually changes from convex to concave, and wherein the first arc portion and the third arc portion are convexly curved, and the second arc portion and the fourth arc portion are concavely curved; and a second arm coupling to the first arm via a pair of parallel bars, wherein the second arm is a mirror image of the first arm.

11. The exercise device of claim 10, wherein the second member and the third member of the first arm point outwardly to a direction away from the first member.

12. The exercise device of claim 11, wherein the first member, the second member and the third member of the first arm are co-planar.

13. The exercise device of claim 10, wherein the first arm and the second arm are made of a resilient material.

14. The exercise device of claim 13, wherein the resilient material comprises a metal, bamboo, plastics, rubber, wood, or synthetic elastomer.

15. The exercise device of claim 10, wherein the first arm and the second arm have a cross-sectional shape of round, oval, rounded polygon, rectangular, square, or the like.

16. The exercise device of claim 10, wherein the first arc portion, the second arc portion, the third arc portion, and the fourth arc portion have the same curvature.

17. The exercise device of claim 10, wherein the first arc portion is coupled to the second arc portion at a first turning point where curvature of the first arm changes from convex to concave, and the third arc portion is connected to the fourth arc portion at a second turning point where curvature of the first arm changes from convex to concave, and the first arm only has the first and second turning points.

* * * * *